US007559832B2

(12) United States Patent
Kilmer

(10) Patent No.: US 7,559,832 B2
(45) Date of Patent: Jul. 14, 2009

(54) WOOD STOVE RADON REDUCTION SYSTEM

(76) Inventor: George Kilmer, 4265 Wilshire Dr., Marion, IN (US) 46952

( * ) Notice: Subject to any disclaimer, the term of this patent is extended or adjusted under 35 U.S.C. 154(b) by 401 days.

(21) Appl. No.: 11/423,180

(22) Filed: Jun. 9, 2006

(65) Prior Publication Data

US 2007/0283947 A1 Dec. 13, 2007

(51) Int. Cl.
*F24F 7/06* (2006.01)
*F24F 7/007* (2006.01)
*F24F 13/08* (2006.01)

(52) U.S. Cl. ..... 454/341; 454/909; 454/340; 454/344; 454/345

(58) Field of Classification Search ..... 126/500; 454/195, 341, 909
See application file for complete search history.

(56) References Cited

U.S. PATENT DOCUMENTS 656,895 A * 8/1900 King ..... 126/293
2,723,875 A * 11/1955 Russell ..... 294/65.5
2,793,057 A * 5/1957 McGugin ..... 285/9.1
2,917,987 A * 12/1959 Hansen et al. ..... 454/195
2,990,198 A * 6/1961 Imming ..... 285/9.1
3,134,345 A 5/1964 King
3,175,552 A 3/1965 Sutton
3,204,776 A * 9/1965 Brown et al. ..... 211/70.6
3,269,608 A * 8/1966 Weber, III ..... 222/180
3,307,528 A * 3/1967 Cook ..... 126/19.5
3,616,622 A * 11/1971 Friedman ..... 55/376
3,831,759 A * 8/1974 Gelman et al. ..... 210/232
4,012,058 A * 3/1977 Patton ..... 285/9.1
4,082,092 A * 4/1978 Foster ..... 128/847
4,244,686 A 1/1981 Scott, Jr.
4,262,608 A 4/1981 Jackson
4,305,373 A * 12/1981 Martenson ..... 126/522
4,470,834 A * 9/1984 Fasanaro et al. ..... 55/501
4,636,776 A * 1/1987 Leaming ..... 340/594
4,843,786 A * 7/1989 Walkinshaw et al. ..... 52/169.5
4,877,182 A 10/1989 Pugh et al.
4,885,984 A * 12/1989 Franceus ..... 454/341
4,905,579 A 3/1990 Dame
4,920,866 A 5/1990 Hoban
4,922,808 A * 5/1990 Smith ..... 454/341
4,988,237 A * 1/1991 Crawshaw ..... 405/229
5,003,865 A * 4/1991 Traudt ..... 454/255
5,096,230 A * 3/1992 Pausch et al. ..... 285/9.1
5,131,887 A * 7/1992 Traudt ..... 454/255
5,191,874 A * 3/1993 McWilliams ..... 126/312
5,277,003 A * 1/1994 Myers ..... 52/169.5

(Continued)

OTHER PUBLICATIONS http://chimneysweeponline.com/hooa.htm The Chimney Sweep Why burn outside combustion air?*

*Primary Examiner*—Kenneth B Rinehart
*Assistant Examiner*—Jorge Pereiro
(74) *Attorney, Agent, or Firm*—Woodard, Emhardt, Moriarty, McNett & Henry LLP

(57) ABSTRACT

A combination of a wood stove and radon collection system. A radon collection tube location in the basement of a building is connected via conduits leading into the combustion chamber of a wood stove. Means secure the radon collection outlet to the stove between the stove door and the stove main body. Metal strips extend across gaps formed between the stove door and stove main body when the outlet is in the installed position.

5 Claims, 2 Drawing Sheets

U.S. PATENT DOCUMENTS 5,301,822 A * 4/1994 Coleman et al. ..... 211/70.6
5,323,760 A * 6/1994 Johnson ..... 126/242
5,479,984 A * 1/1996 Easterbrook et al. ..... 165/96
6,904,723 B1 * 6/2005 Moore et al. ..... 52/169.5
2002/0006774 A1 * 1/2002 Kilburn et al. ..... 454/341
2002/0069599 A1 * 6/2002 Dhallan ..... 52/302.1

* cited by examiner

WOOD STOVE RADON REDUCTION SYSTEM

BACKGROUND OF THE INVENTION

1. Field of the Invention

The present invention relates generally to the field of wood stoves.

2. Description of the Prior Art

In certain areas of the country, radon collects in the basements of buildings. Typically, a blower connected to a collection tube extending outwardly from the building is operable to force the radon gas from the building. The collection tube may extend into the basement or beneath the basement or building slab. A blower is required adding not only to the initial cost of the system but also requiring maintenance and electricity. What is needed is a radon collection system that will use the heat within the heating system to force the radon from the building. Further, there is a need to combine such as system with a wood burning stove, Disclosed herein is such a combination and system.

U.S. Pat. No. 4,877,182 issued to Pugh et al. discloses a typical crawl space ventilation system to eliminate radon gas from the building. U.S. Pat. No. 4,905,579 issued to Dame discloses a plurality of blowers with control valves to control the pressure within the building thereby controlling the flow of radon into the building. U.S. Pat. No. 3,175,552 issued to Sutton discloses a wood burning fireplace having a blower motor for forcing air via the burning logs through the heating outlets extending throughout the room. In order to accelerate the draft out of the chimney of an incinerator, U.S. Pat. No. 3,134,345 issued to King discloses a blower for accelerating the draft through the chimney of the incinerator. Preheated air is ejected into the furnace combustion chamber in U.S. Pat. No. 4,262,608 issued to Jackson.

A number of combinations of heating systems and radon collection systems have been combined in an attempt to minimize radon gas within a building. For example, U.S. Pat. No. 5,191,874 issued to McWilliams discloses a blower for collecting radon gas from inside the building and then directing the gas to the gas outlet of a furnace. U.S. Pat. No. 4,244,686 issued to Scott discloses a method of improving the operating economy of a furnace by supplying to the heating chamber various gases including radon gas. Further, U.S. Pat. No. 4,920,866 issued to Hoban discloses the combination of a wood stove with a tube for collecting radon gas within a building which is injected into the outlet of the stove.

Wood stoves include a door which may be pivoted open for insertion of wood into the combustion chamber. By using such a stove, I have combined a radon collection tube which may be conveniently inserted via the door to direct the radon gas directly into the combustion chamber. Thus, the radon collection system may be conveniently connected or disconnected from the stove by positioning the radon collection tube through the door opening while at the same time inserting additional wood into the combustion chamber.

SUMMARY OF THE INVENTION

One embodiment of the present invention is a wood stove for reducing radon gas and comprising a stove main body forming a wood combustion chamber with an opening for inserting wood therein. A stove door is pivotally mounted to the stove main body adjacent the opening and is movable from a first position whereat the door is away from the opening so wood may be inserted through the opening into the wood combustion chamber to a second position whereat the door extends over the opening but is spaced partially away from the stove main body forming gaps therebetween. An air spout is mounted to the stove main body at the opening. The air spout has a proximal end extending into the opening and a distal end. A first conduit is connected to the distal end of the air spout and extends away therefrom to collect radon gas.

It is an object of the present invention to combine a wood stove with a radon collection system.

A further object of the present invention is to provide a new and improved wood stove.

Yet an additional object of the present invention is to provide a radon collection system that may easily be adapted to a conventional wood stove.

Related objects and advantages of the present invention of the present invention will he apparent from the following description.

DESCRIPTION OF THE PREFERRED EMBODIMENT

Figure 1:
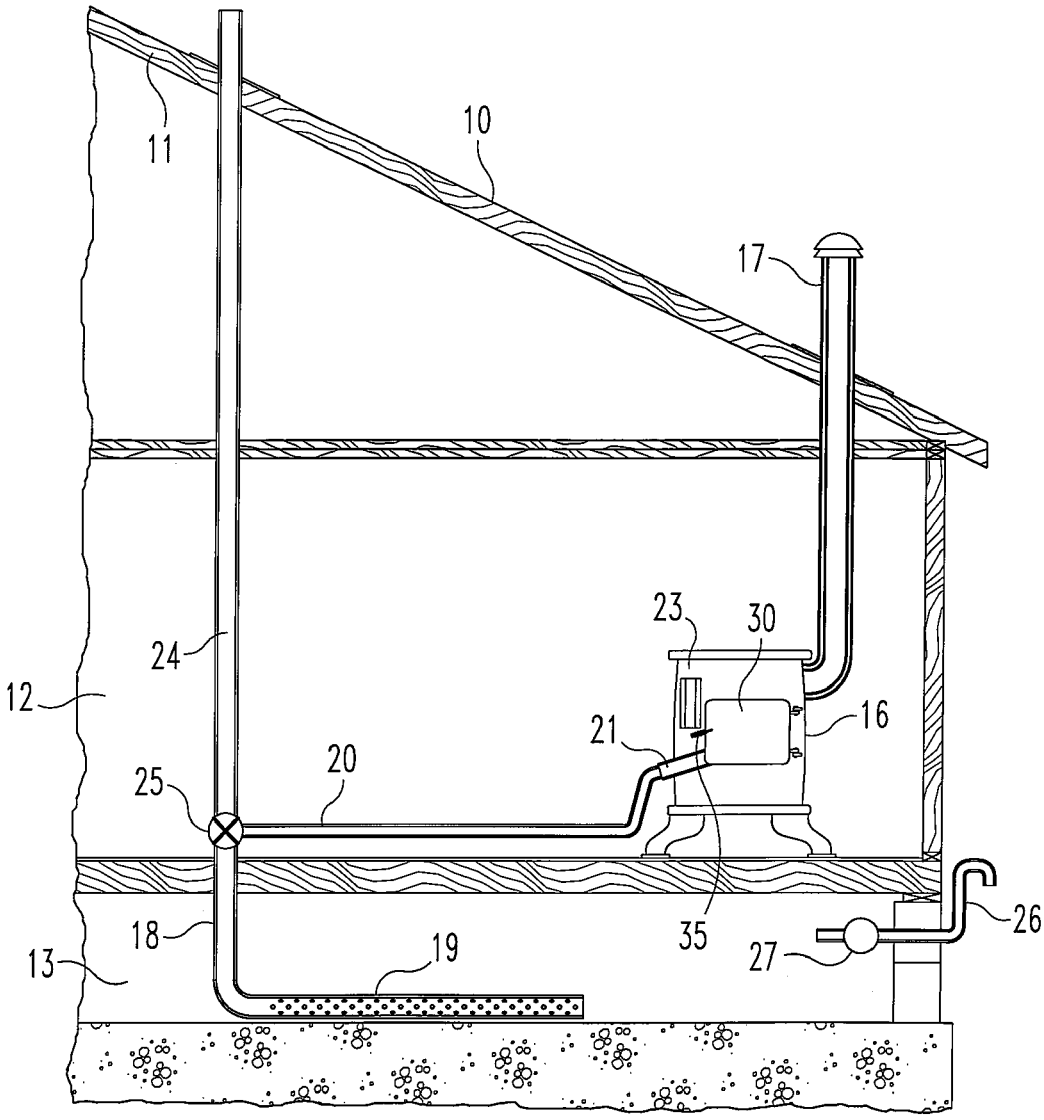
FIG. 1 is a fragmentary schematic representation of the stove and radon collection system incorporating the present invention installed within a building.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the FIG. 1, there is shown in fragment a building 10 having a roof 11, an interior room 12, and basement 13. A wood stove 16 is positioned within room 12 and has a conventional outlet flue 17 extending through the roof 11 to allow the exhaust gases to escape the building. A radon collection system 18 is provided to collect radon gas from the basement by a perforated tube 19, in turn, connected by conduit 20 and tube 21 that extends between the stove door 30 and the main body 23 of stove 16 allowing the radon gas to enter the combustion chamber of the stove. A second conduit 24 extends through the roof 11 allowing gas collected by tube 19 to exit the building when valve 25 is positioned to allow the gas to flow from tube 19 through conduit 24 while blocking flow of gas into tube 20. Likewise, valve 25 has a second position blocking flow of gas from tube 19 through conduit 24 but allowing the gas to flow from tube 19 through conduit 20 to tube 21. An optional inlet tube 26 extends through the wall of the house to the external environment with a fan 27 provided to blow external air into the basement 13 thereby pressurizing the basement and forcing the radon from the building.

Figure 2:
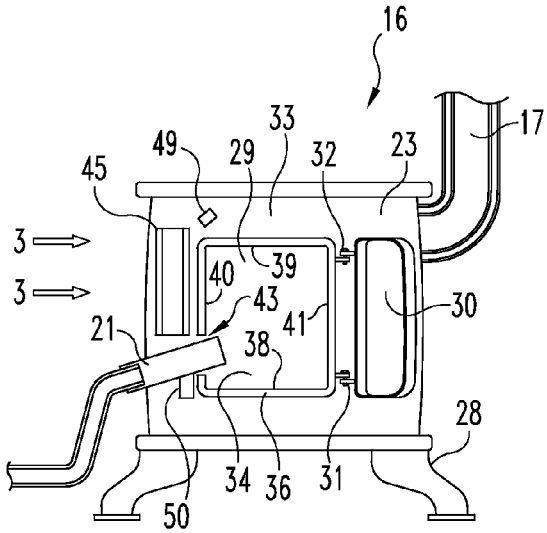
FIG. 2 is an enlarged front view of the stove of FIG. 1 with the stove door shown in the opened position.
Figure 4:
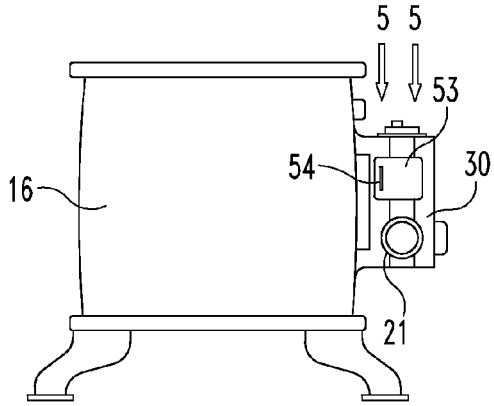
FIG. 4 is the same view as FIG. 3 only showing the stove door partially closed with the radon collection tube installed between the door and stove.

Wood stove 16 has a main body 23 positioned atop a base 28 spacing the main body of the stove above the floor. A combustion chamber 29 is formed within main body 23 with exhaust outlet 17 leading therefrom. Door 30 is pivotally mounted by conventional hinges 31 and 32 to the front 33 of the stove. The door may be pivoted from an open position (FIG. 2) through an intermediate position (FIG. 4) to a completely closed position overlapping opening 34 leading into combustion chamber 29. A handle 35 (FIG. 1) is provided on the exterior surface of door 30 to facilitate the opening and closing of the door.

Figure 3:
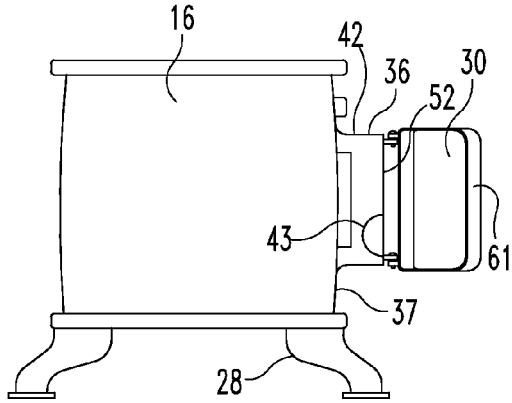
FIG. 3 is a side view looking in the arrows of 3-3 of FIG. 2 with the radon collection tube removed from the stove.

Wall 36 (FIGS. 2 and 3) extends around opening 34 and projects outwardly from the forward facing surface 37 of the stove main body 33. Wall 36 has a lower portion 38 and an upper portion 39 extending across respectively the bottom and top of opening 34. Further, a pair of side portions 40 and 41 (FIG. 2) extend vertically along the opposite sides of opening 34. Portions 38 through 41 form a ledge 42 (FIG. 3) that extends around the opening. Side portion 40 includes a recess 43 formed therein to receive tube 21 connected to the radon collection system.

Figure 6:
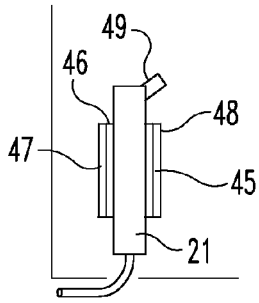
FIG. 6 is a fragmentary and enlarged view of spout 21 mounted in the stored position to the stove.

Tube 21 may be removed from recess 43 to allow door 30 to extend sealingly across opening 34 with the exception that air is allowed to flow through recess 43 into the combustion chamber. When tube 21 is not mounted within recess 43, it is stored in a vertical position in holder 45 mounted to the front surface 37 of the furnace main body. Holder 45 consists of a semi-circular recess 46 (FIG. 6) forming a pair of outwardly extending arms 47 and 48 between which tube 21 may be positioned. A magnet 49 is mounted or the front surface 37 of the stove and is positioned to magnetically hold the metallic tube 21 in place. Alternatively, a magnet may be mounted to tube 21 to secure the tube to holder 45. In such a case, magnet 49 is not necessary.

In order to position tube 21 to extend into the combustion chamber opening, tube 21 is grasped and pulled apart from holder 45. The end of tube 21 is then inserted through recess 43 and into the opening 34 allowing gases within the tube to enter the combustion chamber. Suitable magnets 50 are provided on the front surface 37 of the stove main body immediately adjacent recess 43 to magnetically and removably hold tube 21 in recess 43.

Figure 5:
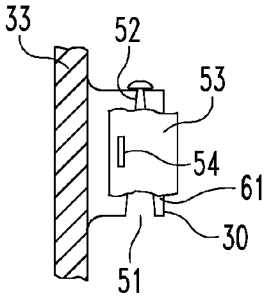
FIG. 5 is an enlarged fragmentary top view looking in the direction of arrows 5-5 of FIG. 4 and viewed in the direction of the arrows.

The external size of tube 21 is such that when installed within recess 43 it projects outwardly of the end or edge of wall 36. For example, the radius of recess 43 may be approximately one-half the diameter of tube 21 if a cylindrical tube is utilized thereby providing for the remaining half of the tube to project outwardly from wall 36. In such a case, stove door 30 will be prevented from closing in a completely sealed position relative to combustion chamber opening 34 creating a gap 51 that extends between the edge 52 (FIG. 5) of wall 36 and the inwardly facing surface of door 30. In order to limit air flow through gap 51, a plurality of aluminum sheets are removably mounted to extend from wall 36 across gap 51 and the sides of door 30. For example, a plurality of aluminum sheets 53 (FIG. 5) are fashioned to fit externally around wall 34 being secured in place by magnets 54 attaching the sheets the stove. The sheets then extend across gap 51 limiting the flow of air through the gap when the door has been moved to an intermediate position located between an open position depicted in FIG. 3 and the completely closed position when the tube 21 is removed from recess 43. Additional magnets may be used to secure aluminum strips 53 to sides 61 of the door. That is, magnets 54 may be used to secure strips 53 directly to the stove or directly to the door. Likewise, magnets 54 may be used to secure the metal strips 53 to both the stove and door with the object being to position and hold the metal strips across gap 51 when the door extends over opening 34 but spaced partially away from the stove main body forming gap 51 due to the presence of tube 21 in recess 43. Strips 53 may be extended on the outwardly facing surface of portions 38-40 to thereby reduce the flow of air via gap 51.

With valve 25 positioned to allow gas flow from tube 18 into conduit 20 and not conduit 24, any radon within basement 13 is allowed to flow into perforated tube 19 and then into the combustion chamber of the stove when tube 21 is mounted to recess 43. By turning on fan 27 forcing external air to flow into the basement via conduit 26, the basement may be purged of radon gas. Tube 21 forms an air spout for collection of air including radon gas within the basement and directing same via opening 34 into the combustion chamber.

Combustion within the stove causes the gas within the combustion chamber to be hotter than gas within tube 20 thereby drawing up air and radon from the basement through tube 19 and eventually out of flue 17. After valve 25 is closed to tube 20 and opened to tube 24, spout 21 is removed from recess 43, the draft is broken and radon will not flow up to stove 16. No cap is needed to extend across recess 43. Valve 25 is in a position blocking flow into conduit 20 while allowing gas flow from tube 18 to conduit 24.

Many variations are contemplated and included in the present invention. For example, the drawing depicts a building have a basement; however, the radon collection system may also be used where the building does not have a basement. In such a case, the radon collection tube may be positioned beneath the slap supporting the building.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A stove for reducing radon gas in a building comprising:

a stove main body for heating a building and having a combustion chamber and an opening leading into said chamber;

a door hingedly mounted to said main body and swingable from a first position uncovering said opening to a second position extending across said opening;

a radon collecting tube removably mounted to said stove at said opening and having a proximal end opening into said chamber at said opening and a distal end opening into said building wherein gas within said chamber is hotter than gas within said tube to draw radon gas from said tube into said chamber, said tube being sized to position said door at said second position whereat said door extends over said opening but is spaced partially away from said stove main body forming gaps therebetween and wherein said door and said stove form a recess into which said tube extends; and, magnets for removably holding said tube at said opening and also for holding said tube adjacent said stove when removed from said opening to store same.

2. The stove of claim 1 wherein said building has a basement and wherein:

said radon collecting tube extends from said basement; and further comprising:

a fan; and, a fresh air conduit leading from external of the building into said basement with said fan forcing outside fresh air through said fresh air conduit into the basement providing external air into the building and replenishment of air expelled from the building containing radon.

3. A heating system for a building comprising:

a wood stove with a combustion chamber and an opening leading to said chamber to insert wood therein, said stove located in said building and including a flue extending from said stove to exteriorly of said building;

an air spout mounted to said stove at said opening;

a door movably mounted to said stove and movable from a first position uncovering said opening to allow wood to be inserted into said chamber to a second position extending across said opening, said door when in said second position partially spaced apart from said wood stove by said air spout creating gaps between said door and stove at said opening;

a radon collecting conduit within said building, said conduit having a first branch and a second branch connected together with said first branch opening at one end into said combustion chamber at said opening and opening at another end in said building receiving radon in said building and said second branch leading from said first branch to exteriorly of said building directing radon in said building to exteriorly of said building;

a plurality of strips mounted to said stove and extending across said gaps when said door is in said second position limiting gas flow through said gaps;

magnets removably holding said strips to said stove when extending into said opening;

a fresh air conduit leading from outside said building to inside said building providing fresh air to said building; and, a valve associated with said conduit to direct gas through said first branch and through said second branch.

4. A wood stove for reducing radon gas comprising:

a stove main body forming a wood combustion chamber with an opening for inserting wood therein;

a stove door pivotally mounted to said stove main body adjacent said opening and movable from a first position whereat said door is away from said opening so wood may be inserted through said opening into said wood combustion chamber to a second position;

an air spout mounted to said stove main body at said opening, said air spout having an open proximal end extending into said opening and a distal end, said air spout being sized to position said door at said second position so said door extends over said opening but spaced partially away from said stove main body forming gaps between said door and said stove main body and wherein said door and said stove main body further form a recess into which said air spout extends;

a first conduit connected to said distal end of said air spout and extending away therefrom to collect radon gas, said first conduit having a proximal end opening via said air spout into said chamber at said recess and a distal end opening into said building wherein gas within said chamber is hotter than gas within said first conduit to draw radon gas from said first conduit into said chamber; and, metal strips mounted to the stove at said opening and extending over said gaps when said door is in said second position to limit air flow through said gaps, said strips spaced apart from said recess which provides an air inlet when said door is closed while said air spout is removed from said recess;

a magnet removably securing said spout to said stove when said spout is removed from said opening; and, additional magnets removably securing said strips to said stove across said gaps.

5. The stove of claim 1 and further comprising:

a second conduit extending from said first conduit; and, a controllable valve associated with said first conduit and said second conduit to direct gas flow through said first conduit and said second conduit.

* * * * *